US009173435B2

(12) United States Patent
Bailey et al.

(10) Patent No.: US 9,173,435 B2
(45) Date of Patent: Nov. 3, 2015

(54) CONFIGURABLE BRA

(71) Applicants: Thereasa Bailey, Belleville, MI (US); R. C. Bailey, Belleville, MI (US)

(72) Inventors: Thereasa Bailey, Belleville, MI (US); R. C. Bailey, Belleville, MI (US)

( * ) Notice: Subject to any disclaimer, the term of this patent is extended or adjusted under 35 U.S.C. 154(b) by 0 days.

(21) Appl. No.: 14/468,945

(22) Filed: Aug. 26, 2014

(65) Prior Publication Data

US 2015/0004877 A1 Jan. 1, 2015

Related U.S. Application Data

(63) Continuation-in-part of application No. 14/177,196, filed on Feb. 10, 2014, now abandoned, which is a continuation-in-part of application No. 13/399,427, filed on Feb. 17, 2012, now abandoned.

(51) Int. Cl.

| | |
|---|---|
| ***A41C 3/00*** | (2006.01) |
| ***A41C 3/12*** | (2006.01) |
| ***A41F 15/00*** | (2006.01) |
| ***A41F 15/02*** | (2006.01) |
| ***A41C 3/02*** | (2006.01) |

(52) U.S. Cl.

CPC ... *A41C 3/12* (2013.01); *A41C 3/00* (2013.01); *A41C 3/0028* (2013.01); *A41C 3/02* (2013.01); *A41F 15/002* (2013.01); *A41F 15/02* (2013.01)

(58) Field of Classification Search

CPC ..... A41F 1/006; A41F 15/00; A41F 15/002; A41F 15/005; A41F 15/02; A41B 9/16

USPC ..... 450/91, 52, 58, 86–88, 1, 79–80, 450/82–85, 26, 23, 14, 11–12, 9, 5–6, 450/30–32, 35; 2/67, 244, 44, 45, 460

See application file for complete search history.

(56) References Cited

U.S. PATENT DOCUMENTS

| | | | | | |
|---|---|---|---|---|---|
| 1,849,514 | A | | 3/1932 | Edelmann | |
| 2,333,434 | A | | 11/1943 | Middlecoff | |
| 2,486,836 | A | | 11/1949 | Frank | |
| 3,191,603 | A | * | 6/1965 | Marino | 450/82 |
| 4,300,568 | A | * | 11/1981 | Blanckmeister | 450/85 |
| 4,612,935 | A | * | 9/1986 | Greifer | 450/86 |
| 4,764,988 | A | * | 8/1988 | Reaver | 2/268 |
| 4,858,249 | A | * | 8/1989 | Stewart | 2/305 |
| 5,457,852 | A | * | 10/1995 | Liu | 24/13 |
| 5,478,278 | A | * | 12/1995 | Greenblatt | 450/32 |
| 5,921,845 | A | * | 7/1999 | Scholtz | 450/86 |
| 5,957,748 | A | * | 9/1999 | Ichiha | 450/58 |
| 6,123,601 | A | * | 9/2000 | Hildebrandt | 450/82 |
| 6,135,853 | A | * | 10/2000 | Hopson | 450/86 |
| 6,155,906 | A | | 12/2000 | May | |
| 6,200,194 | B1 | | 3/2001 | Grier | |
| 7,001,240 | B1 | | 2/2006 | Huffman-jimenez | |
| 7,435,156 | B1 | | 10/2008 | Liu | |
| 7,887,390 | B2 | | 2/2011 | Dowe | |
| 7,931,521 | B1 | * | 4/2011 | Griffin | 450/86 |
| 8,123,587 | B2 | | 2/2012 | Liegey | |

(Continued)

*Primary Examiner* — Khao Huynh
*Assistant Examiner* — Brieanna Szafran
(74) *Attorney, Agent, or Firm* — Vincent Re PLLC

(57) ABSTRACT

An adjustable bra is provided permitting the wearer to adjust how the bra provides support to the wearer. The bra includes at least one shoulder strap and a rear band. Attachment of the shoulder strap to the rear band can be configured at a plurality of positions along the rear band. The bra can include a second shoulder strap also configured to attach at a plurality of positions along the rear band.

12 Claims, 6 Drawing Sheets

(56) References Cited

U.S. PATENT DOCUMENTS

| | | | | |
|---|---|---|---|---|
| 2002/0193048 | A1 | 12/2002 | Kato et al. | |
| 2003/0003844 | A1* | 1/2003 | Jones et al. | 450/88 |
| 2003/0166376 | A1 | 9/2003 | Hanson | |
| 2004/0128733 | A1 | 7/2004 | Hendricks | |
| 2009/0258572 | A1 | 10/2009 | Chayo | |
| 2010/0144241 | A1 | 6/2010 | Dowe | |
| 2011/0028070 | A1 | 2/2011 | Pfitzenmayer | |
| 2012/0028539 | A1* | 2/2012 | McCarty | 450/1 |
| 2012/0135667 | A1 | 5/2012 | Chan | |
| 2012/0324631 | A1* | 12/2012 | Peper et al. | 2/244 |
| 2013/0065483 | A1* | 3/2013 | Liguori | 450/1 |
| 2013/0225043 | A1* | 8/2013 | Musarra-Leonard | 450/31 |
| 2013/0254977 | A1* | 10/2013 | Crouch | 2/338 |

* cited by examiner

CONFIGURABLE BRA

CROSS-REFERENCE TO RELATED APPLICATIONS

This disclosure is a continuation-in-part of U.S. patent application Ser. No. 14/177,196 filed on Feb. 10, 2014 which is a continuation of U.S. patent application Ser. No. 13/399,427 filed on Feb. 17, 2012 which are hereby incorporated by reference.

TECHNICAL FIELD

This disclosure is related to a bra with adjustable straps. In particular, the disclosure is related to a bra whereupon a strap or straps can be affixed to a plurality of locations along a rear band of the bra.

BACKGROUND

The statements in this section merely provide background information related to the present disclosure. Accordingly, such statements are not intended to constitute an admission of prior art.

Brassieres or bras are common accessories generally worn by women to support and cradle their breasts. From the time a young girl starts to develop they learn to wear a bra and do so for the rest of their lives. The average woman may accumulate many, many bras during their lifetime each with different purposes, styles and comfort levels.

Proper support and sizing of a bra is important. Back pain and other ailments have been linked to women wearing improperly sized bras. Bras are sized according to cup size but can be presented as a one-size-fits-all solution for a given cup size.

Bras come in a wide variety of colors and styles. Bras can be expensive and can take up large amounts of storage area. A woman may spend a great deal of money to have a wide variety of bras, and the woman may be inconvenienced with crowded closet and drawer spaces, with different varieties of bras filling storage areas that she would prefer to keep available for other clothes.

SUMMARY

An adjustable bra is provided permitting the wearer to adjust how the bra provides support to the wearer. The bra includes at least one shoulder strap and a rear band. Attachment of the shoulder strap to the rear band can be configured at a plurality of positions along the rear band. The bra can include a second shoulder strap also configured to attach at a plurality of positions along the rear band.

BRIEF DESCRIPTION OF THE DRAWINGS

One or more embodiments will now be described, by way of example, with reference to the accompanying drawings, in which.

DETAILED DESCRIPTION

Bras come in a wide variety of colors, styles, fashions, etc. Some bras are known in the art to be reversible, where the wearer can pick between a one color on one side of the bra and another color on the other side of the bra. While these bras do provide a reversible feature, there still exists a desire in the art to provide a reversible bra that may include a front closure for additional convenience. Also, it would be beneficial in the art to provide a reversible bra that includes changeable straps to wear the bra with the latest clothing styles. The present disclosure includes a reversible bra with a reversible clasp that fastens in the front, between a pair of cups. The present disclosure includes a reversible bra as a two-in-one style undergarment. The reversible bra includes a pair of cups with different colors or designs on each side to enable the user to choose between two designs to wear that day. By providing two design options in a single bra the user reduces the costs they spend on expensive lingerie, and reduces the amount of space used to store the brassiere.

Further, bras include straps that are rigidly fixed, causing women to have to wear poorly adjusted or incorrectly sized bras that provide inadequate or inappropriately applied support. Such poorly adjusted or incorrectly sized bras can cause back pain, chest pain, posture problems, or other problems. An adjustable bra is disclosed, wherein a position that the bra straps attach to a back of the bra can be adjusted. Such adjustment can take a number of forms. A plurality of fixed attachment points can be provided to which the straps to attach. Such fixed attachment points can include quick or snap connect fittings for easy adjustment. In another example, an adjustable Velcro® wrap can be used to attach the strap or straps to any location along a back of a bra. In another example, a sliding attachment mechanism can permit adjustment of attachment points along a back side of a bra. A number of exemplary devices are envisioned for permitting adjustment of strap positions, and the disclosure is not intended to be limited to the particular examples provided herein. The disclosed device can but need not include a bra underwire as is known in the art.

Figure 1:
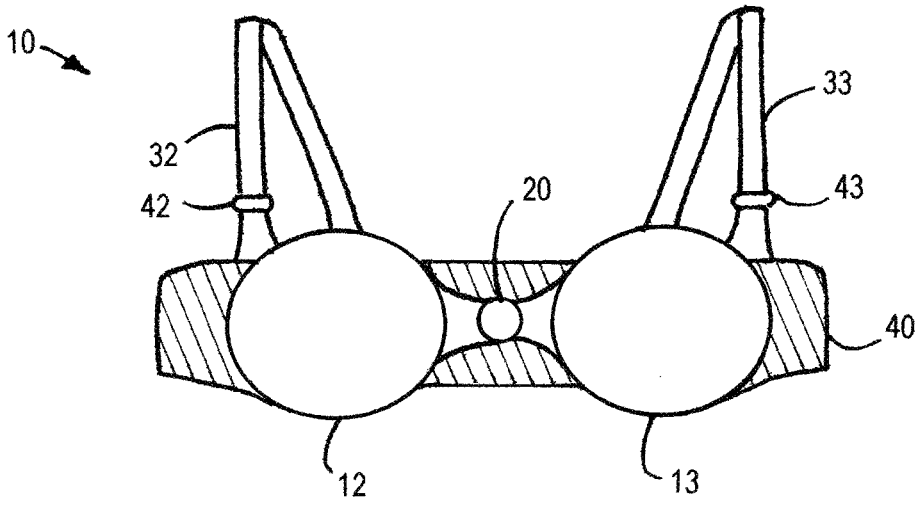
FIG. 1 illustrates an exemplary bra including a clasp located between the cups, in accordance with the present disclosure.

Referring now to the drawings, wherein the showings are for the purpose of illustrating certain exemplary embodiments only and not for the purpose of limiting the same, FIG. 1 illustrates an exemplary bra including a clasp located between the cups. Bra 10 is illustrated including cups 12 and 13, straps 32 and 33, rear band 40, and central clasp 20. Bra 10 can be single sided, with an outside configured to be stylish and with an inside configured for comfort. Bra 10 can be reversible, with both sides of the bra being configured to appear stylish and be comfortable next to the skin of the wearer. Cups 12 and 13 are configured to support a woman's breasts and come in exemplary standard sizes (e.g., size A, B, C, D etc.) Straps 32 and 33 are attached to a front side of bra 10 and are configured to go over a shoulder or both shoulders of the wearer to provide support. Straps 32 and 33 are omitted in strapless versions of bra 10. Rear band 40 connects to both cups 12 and 13 and runs around the back of the wearer. Rear band 40 can be made of a number of different materials, for example, including but not limited to cotton, nylon, polyester, and satin. Any of the components of bra 10 can be ornamental, for example, with cloth being constructed with lace and other ornamental stitches or patterns. Optional attachment rings 42 and 43 are shown joining straps 32 and 33, respectively, to the rest of bra 10. In other embodiments, straps 32 and 33 can be sewn directly to band 40 or cups 12 and 13, respectively. Straps 32 and 33 can be adjustable in length.

Central clasp 20 is selectively engaged and disengaged to put on or take off bra 10. Clasp 20 can include devices known in the art, such as a plurality of small hook and loop style wires that one pushes together and unhooks to disengage the clasp. In another embodiment, clasp 20 can include a snap type connection, for example, including plastic male and female snap housings configured to easily release by the depression of one or two buttons on the clasp. In another embodiment, clasp 20 can include an ornamental medallion face with a hook or snap feature. An another embodiment, clasp 20 can include a double sided ornamental medallion or can include a decorative medallion face on each of a first side and a second side, such that a reversible bra will have one face of the ornamental medallion showing regardless of which side of the reversible bra is worn on the outside.

Figure 2:
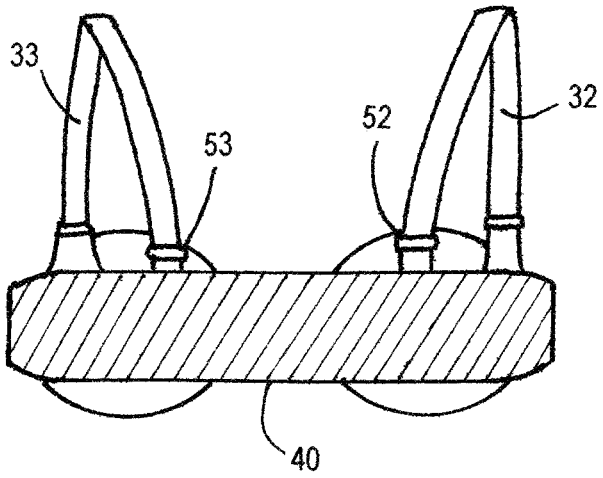
FIG. 2 illustrates a reverse side of the reversible bra of FIG. 1, in accordance with the present disclosure.

FIG. 2 illustrates a reverse side of the reversible bra of FIG. 1. Rear band 40 is illustrated attached to straps 32 and 33 at fixed attachment points 52 and 53, respectively. The fixed attachment points can include a number of different embodiments, for example, with the straps being sewn directly to band 40 or with intervening attachment rings.

Figure 3:
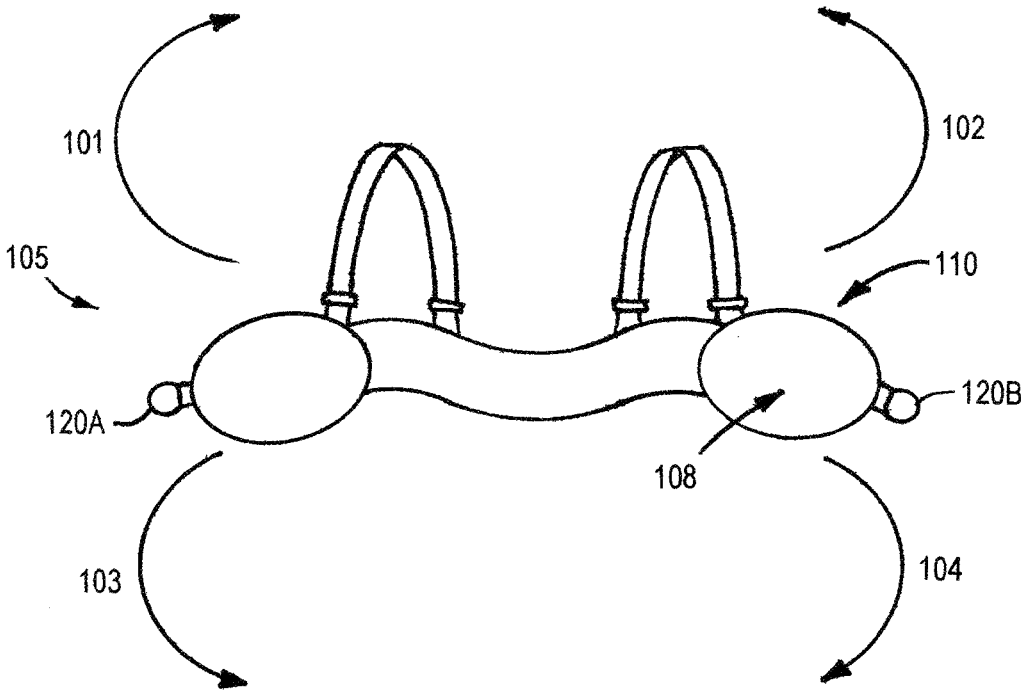
FIG. 3 illustrates an exemplary reversible bra with a clasp unhooked, illustrating the reversible operation of the bra, in accordance with the present disclosure.

FIG. 3 illustrates an exemplary reversible bra with a clasp unhooked, illustrating the reversible operation of the bra. Exemplary bra 105 is illustrated as a reversible bra, with a first stylish side 108 and a second stylish side 110. First stylish side 108 and second stylish side 110 can be the same or similar, or side 108 and side 110 can be different in style, color, pattern, ornamentation, material, or comfort level. Clasp portions 120A and 120B are illustrated on opposite ends of bra 105 and are configured to be joined together to make a secure connection, forming an engaged connection and being capable of providing the required support to the wearer. In one configuration, clasp portion 120A can be moved in direction 101 and clasp portion 120B can be moved in direction 102, such that bra 105 can be worn with side 108 on the outside. Alternatively, the same bra 105 can be configured with clasp portion 120A moving in direction 103 and clasp portion 120B can be moved in direction 104, such that bra 105 can be worn with side 110 on the outside.

Figure 4:
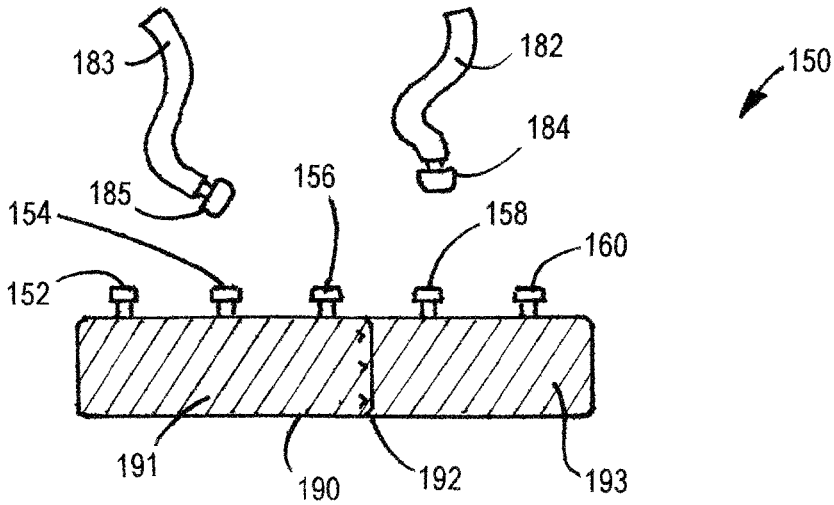
FIG. 4 illustrates a back of a bra including a plurality of fixed attachment points, in accordance with the present disclosure.

FIG. 4 illustrates a back of a bra including a plurality of fixed attachment points. Bra 150 is illustrated including rear band 190 and straps 182 and 183. Strap 182 includes attachment hardware 184, and strap 183 includes attachment hardware 185. Attachment hardware 184 and 185 can be configured to selectively attach to any of a plurality of fixed attachment points 152, 154, 156, 158, and 160. Rear band 190 can be a single piece rear band such as is illustrated in FIG. 2, with the bra including a clasp between the cups. In the embodiment of FIG. 4, the rear band 190 is illustrated including a rear connecting attachment 192 connecting a left side 191 of band 190 and a right side 193 of band 190. In such an embodiment, no clasp between the cups is necessary. By selecting which attachment point the straps are attached to, the wearer can create a number of configurations for the bra and change the way in which the bra supports the breasts and the way in which the straps fit the shoulders of the wearer. Any number of alternative attachment points can be configured upon a bra. Any known buckle, snap, button and loop configuration, or attachment device can be used to connect the attachment hardware to the attachment points.

Figure 5A:
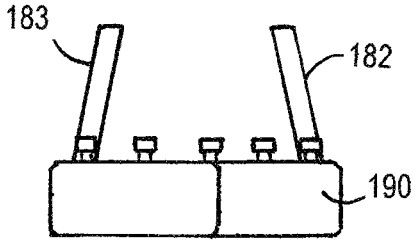
FIGS. 5A-5E illustrate the bra of FIG. 4, including a number of exemplary strap configurations that can be utilized, in accordance with the present disclosure.
Figure 5B:
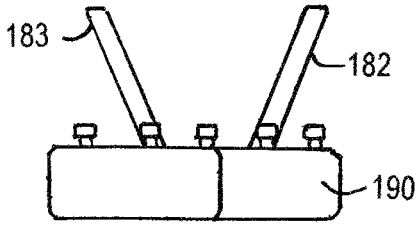
Figure 5C:
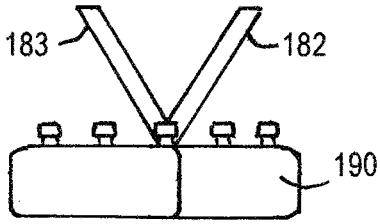
Figure 5D:
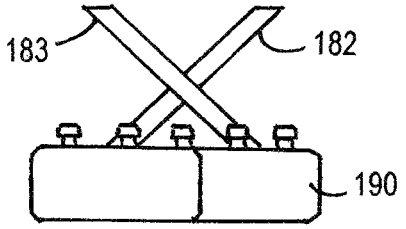
Figure 5E:
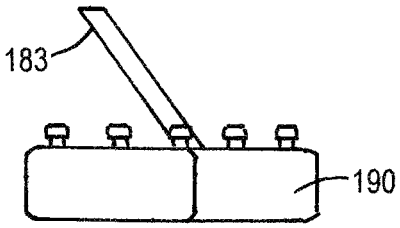

FIGS. 5A-5E illustrate the bra of FIG. 4, including a number of exemplary strap configurations that can be utilized. FIG. 5A illustrates straps 182 and 183 connecting to rear band 190 at two outermost attachment points. FIG. 5B illustrates straps 182 and 183 connecting to rear band 190 at two inner attachment points. FIG. 5C illustrates straps 182 and 183 connecting to rear band 190 at a single attachment point or at two co-located attachment points. FIG. 5D illustrates straps 182 and 183 connecting to rear band 190 at two inner attachment points, with the straps crossing. FIG. 5E illustrates single strap 183 connecting to rear band 190 at a central attachment point. According to different embodiments of the disclosure can include a single strap, two straps, or selectively removable straps. A number of different configurations are envisioned, and the disclosure is not intended to be limited to the examples disclosed herein. Straps 182 and 183 are illustrated being attached symmetrically in FIGS. 5A-5D. However it will be appreciated that wearers with certain issues such as having had a mastectomy can attach the straps non-symmetrically based upon a desired configuration of the bra.

Figure 6:
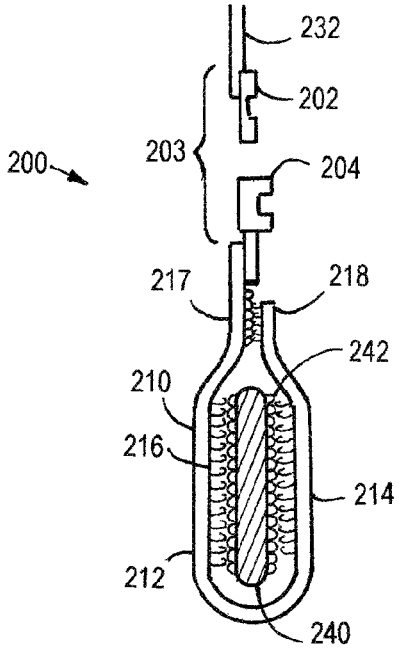
FIG. 6 illustrates an exemplary Velcro® wrap attachment point attached to a back of a bra, in accordance with the present disclosure.

FIG. 6 illustrates an exemplary Velcro®, hook and loop, wrap attachment point attached to a back of a bra. Bra 200 is illustrated in section, including rear band 240 and wrap attachment point (a flexible attachment band) 210 wrapped around band 240. Band 240 includes, a matrix of exemplary loops 242 of a Velcro®, hoop and loop, configuration. Wrap attachment point 210 includes a matrix of exemplary hooks 216 of a Velcro®, hook and loop, configuration, such that when wrap attachment point 210 is wrapped around rear band 240, the wrap attachment point 210 is securely attached to band 240. The mating patches of Velcro®, hook and loop, 216 & 242 are configured to releasably adhere to each other when the patches are pressed together. Loops 242 can be located along an entire length of rear band 240 or along portions of rear band 240, such that selective placement of wrap attachment point 210 on rear band 240 creates an attachment point on rear band 240 where ever the wearer selects to place the wrap attachment point 210. Hooks and loops are illustrated on first side 212 of wrap attachment point 210 and second side 214 of wrap attachment point 210, although such hooks and loops could be included on only one side of wrap attachment point 210. A second optional hook and loop connection is made between points 217 and 218 of wrap attachment point 210. so that the wrap attachment point (flexible attachment band) 210 circumscribes the rear band 240 after the wrap attachment point (flexible attachment band) 210 is wrapped around the rear band 240 Female portion 204 of snap buckle 203 is illustrated connected to wrap attachment point 210, and male portion 202 of snap buckle 203 is illustrated connected to shoulder strap 232. FIG. 6 illustrates the shoulder strap as being separable from the wrap attachment point. An alternative embodiment is envisioned wherein the wrap attachment point is simply a part of an end of the shoulder strap.

Figure 7:
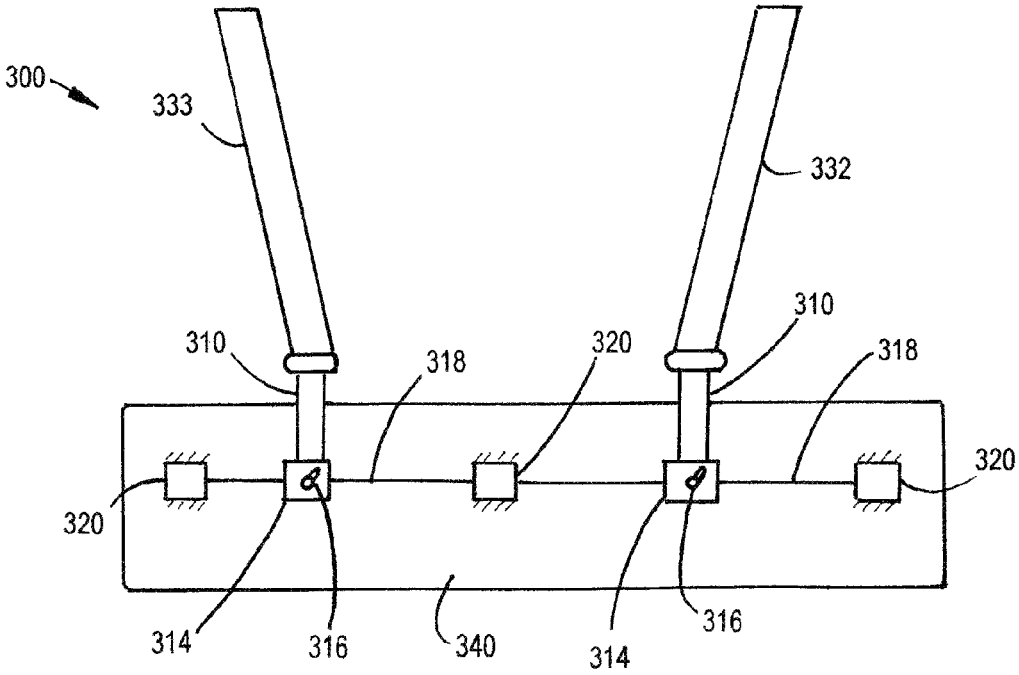
FIG. 7 illustrates an exemplary bra including sliding attachment points, in accordance with the present disclosure.

FIG. 7 illustrates an exemplary bra including sliding attachment points. Bra 300 is illustrated including straps 332 and 333 and rear band 340. Two connection wires 318 are illustrated connected to band 340 by anchors 320. Sliding attachment points 310 are illustrated attached to wires 318 such that each of sliding attachment points 310 can be adjusted to any point along the respective wire 318. Each of sliding attachment points 310 include gripping mechanism 314 selectively gripping to wires 318 by operation of an exemplary locking switch 316. Any mechanical gripping mechanism causing a device to clamp down on a wire can be used in mechanisms 314. In an alternative to the wire configuration, a polymer plate with indentations or tooth features could be fastened to the rear strap and sliding attachment points could adjust and selectively secure to the indentations or tooth features. Any number of alternative sliding devices are envisioned for similar use on a bra, permitting the wearer to slide one or more attachment points long the rear band, and the disclosure is not intended to be limited to the particular examples provided herein.

Figure 8:
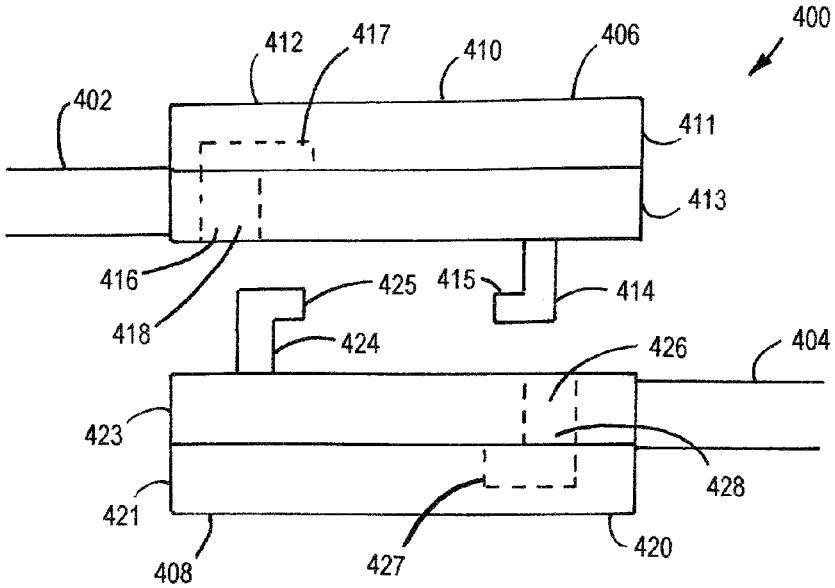
FIG. 8 illustrates an exemplary reversible clasp, in accordance with the present disclosure.

FIG. 8 illustrates an exemplary reversible clasp. Configuration 400 includes a first clasp half 410 attached to a cup strap 402 and second clasp half 420 attached to a cup strap 404. Cup strap 402 is connected to a first bra cup, and cup strap 404 is connected to a second bra cup. According to one embodiment, the associated bra is sized and configured with at least slightly elastic material, such that when worn by a wearer, each of the cup straps will pull slightly outwardly on the clasp halves. Clasp half 410 and clasp half 420 are configured to be hooked together such that the outward force applied by the cup straps 402 and 404 mechanically engage hook features 414 and 424 and cause configuration 400 to firmly remain selectably engaged. When the user wishes to disengage the clasp halves, she can pull inward on the bra straps 402 and 404, thereby disengaging hook features 414 and 424 and disengaging configuration 400.

A wide variety of hook features and mechanically engaging mechanisms utilizing clasp halves are envisioned. The disclosure is not intended to be limited to the particular examples provided herein. In the particular example illustrated by FIG. 8, configuration 400 includes clasp half 410 including hook feature 414 and a hook receiving cavity 416 and clasp half 420 including hook feature 424 and a hook receiving cavity 426. Hook receiving cavity 416 includes widened entrance channel 418 configured to permit barb section 425 of hook feature 424 to pass through channel 418, and cavity 416 further includes recess 417 configured to receive and hold barb section 425 when the outward force is applied by cup straps 402 and 404. Clasp half 410 can be made of two half sections 411 and 413, for example, to permit or ease manufacturing of recess 417. Similarly, hook receiving cavity 426 includes widened entrance channel 428 configured to permit barb section 415 of hook feature 414 to pass through channel 428, and cavity 426 further includes recess 427 configured to receive and hold barb section 415 when the outward force is applied by cup straps 402 and 404. Clasp half 420 can be made of two half sections 421 and 423, for example, to permit or ease manufacturing of recess 427.

Clasp half 410 and clasp half 420 can be plain and undecorated. In other embodiments, face 406 of clasp half 410 and face 408 of clasp half 420 can be decorated. Faces 406 and 408 can be etched, molded, dyed, bejeweled, include insets or adhesive stickers, or be decorated in according to any possible pattern or design. Clasp half 410 and 420 can be constructed of any of a number of metals, plastics or polymers, wood, or any other material or combination of materials. The hook feature and cavity combinations of FIG. 8 can be replaced with more conventional wire hook and loop sections used commonly to attach bras in the back. Such convention wire hook and loop sections can be fastened to cloth sections and have decorative medallions affixed to outward sections to create a reversible clasp similar to the clasp of FIG. 8.

Figure 9:
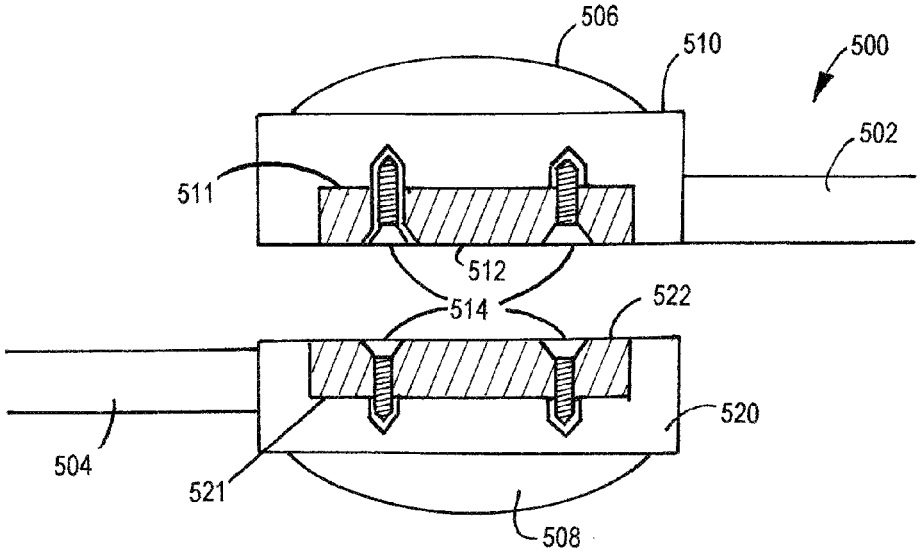
FIG. 9 illustrates in section another exemplary embodiment of a reversible clasp, in accordance with the present disclosure.

FIG. 9 illustrates in section another exemplary embodiment of a reversible clasp. Configuration 500 includes clasp half 510 attached to cup strap 502 and clasp half 520 attached to cup strap 504. Clasp half 510 includes magnetic insert 512 within cavity 511 and fasteners 514 holding insert 512 in place, and clasp half 520 includes magnetic insert 522 within cavity 521 and fasteners 514 holding insert 522 in place. Magnetic inserts 512 and 522 are aligned and oriented such that they attract each other and cause configuration 500 to selectably engage. Magnetic inserts 512 and 522 can be made of different types, sizes, and shapes of magnets. According to one embodiment, magnetic inserts 512 and 522 can be constructed of rare earth magnets known in the art to provide increased magnetic attraction and lighter weight clasp halves as compared to other conventional magnets. Clasp half 510 includes decorative attachment 506 affixed thereto, and clasp half 520 includes decorative attachment 508 affixed thereto.

Figure 10:
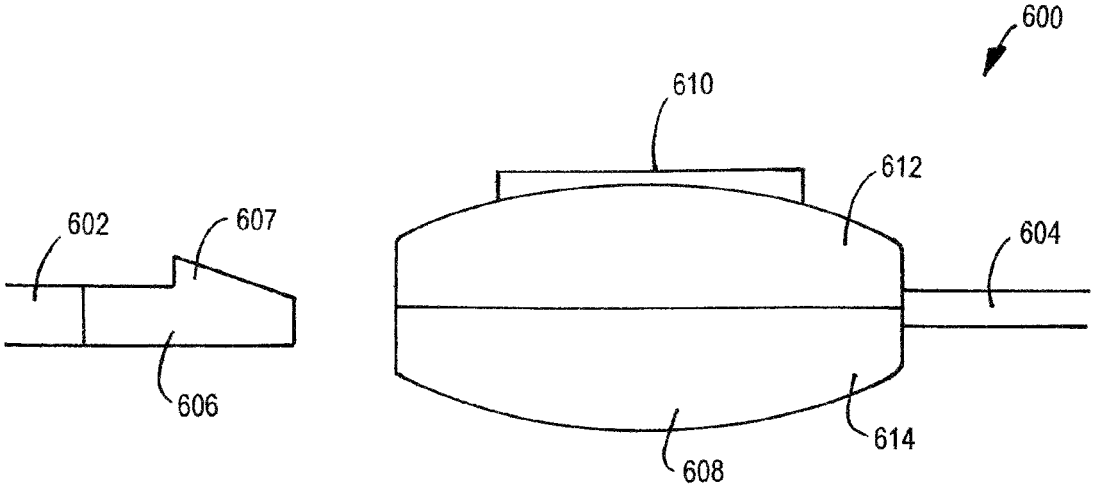
FIG. 10 illustrates in section another exemplary embodiment of a reversible clasp, in accordance with the present disclosure.

FIG. 10 illustrates in section another exemplary embodiment of a reversible clasp. Configuration 600 includes buckle body 614 attached to cup strap 604 and configured to receive and selectably engage to buckle insert 606 attached to cup strap 602. Buckle body 614 includes exemplary spring loaded button 610 and mechanisms within body 614 configured according to methods known in the art to receive and grip to barb 607 of insert 606. Upon manual depression of button 610, the mechanisms within body release barb 607 permitting configuration 600 to disengage. Buckle body 614 can include two half sections 612 and 614 configured to house and contain the mechanisms there within and button 610.

The disclosure has described certain preferred embodiments and modifications of those embodiments. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. A device comprising an adjustable bra, the device comprising:

a rear band, with one end of the rear band attached to a first bra cup and a second end of the rear band attached to a second bra cup;

at least one shoulder strap;

a flexible attachment band connected to the at least one shoulder strap and wrapping around the rear band to circumscribe the rear band;

wherein the at least one shoulder strap being connected to the flexible attachment band by a female and male engaging buckle member;

two mating patches of hook and loop fastener, one of the patches of hook and loop fastener comprising a matrix of flexible hooks and the other of the patches of hook and loop fastener comprising a matrix of flexible loops, wherein the two mating patches of hook and loop fastener are configured to releasably adhere to each other when the two mating patches of hook and loop fastener are pressed together;

wherein a first of the two mating patches of hook and loop fastener is affixed to a surface of the flexible attachment band;

wherein a second of the two mating patches of hook and loop fastener is affixed along the rear band and is configured to enable selective placement of the flexible attachment band on the rear band at the discretion of the wearer; and wherein the flexible attachment band comprises a second set of mating patches of hook and loop fastener, one portion of the second set of mating patches of hook and loop fastener is attached at a first end of the flexible attachment band and a second portion of the second set of mating patches of hook and loop fastener is attached at a second end of the flexible attachment band such that the first and second ends of the flexible attachment band are attached together in order to circumscribe the rear band after the flexible attachment band is wrapped around the rear band.

2. The device of claim 1, further comprising: a second shoulder strap; and a second flexible attachment band.

3. The device of claim 1, wherein the second of the two mating patches of hook and loop fastener affixed along the rear band runs along an entire length of the rear band.

4. The device of claim 1, wherein the second of the two mating patches of hook and loop fastener affixed along the rear band runs along an entire length of the rear band configured to correspond to the back of a wearer.

5. The device of claim 1, further comprising: a clasp located between the first and second bra cups.

6. The device of claim 5, wherein the clasp comprises a decorative medallion face.

7. The device of claim 5, wherein the adjustable bra is reversible.

8. The device of claim 7, wherein the clasp comprises a decorative medallion face on each of a first side and a second side of the clasp.

9. The device of claim 1, wherein the adjustable bra is reversible.

10. The device of claim 9, wherein the rear band comprises a rear connecting attachment.

11. The device of claim 1, wherein the at least one shoulder strap is adjustable in length.

12. The device of claim 1, wherein the at least one shoulder strap is removable.

* * * * *